US005827033A

United States Patent [19]

Feldman

[11] Patent Number: 5,827,033

[45] Date of Patent: Oct. 27, 1998

[54] CASE MAKING DIES AND SYSTEMS, AND METHODS OF ADJUSTMENT, ALIGNMENT AND USE THEREOF

[75] Inventor: Richard L. Feldman, Waverly, Nebr.

[73] Assignee: James D. Welch, Omaha, Nebr.; A Part Interest

[21] Appl. No.: 659,752

[22] Filed: Jun. 6, 1996

[51] Int. Cl.[6] ..... B42C 7/00

[52] U.S. Cl. ..... 412/3; 412/17; 412/1

[58] Field of Search ..... 412/1, 3, 4, 6, 412/9, 14, 17, 19; 83/373, 344

[56] References Cited

U.S. PATENT DOCUMENTS

| | | | |
|---|---|---|---|
| 4,732,376 | 3/1988 | Umezawa | 271/267 |
| 4,764,073 | 8/1988 | Gaslichs et al. | 412/69 |
| 4,863,331 | 9/1989 | Torti | 412/3 |
| 4,898,506 | 2/1990 | Lavtar | 412/17 X |
| 5,133,169 | 7/1992 | Tesch, Jr. et al. | 53/247 |
| 5,364,215 | 11/1994 | Snellman et al. | 412/3 |
| 5,413,446 | 5/1995 | Rathert et al. | 412/3 X |

*Primary Examiner*—Willmon Fridie, Jr.
*Attorney, Agent, or Firm*—James D. Welch

[57] ABSTRACT

Disclosed are adjustable size dies for use in case making systems. Also disclosed are methods of adjustment, alignment and of use of the adjustable size dies in case making systems which are especially well suited for use in the practice of book binding. Appropriate practice of the present invention provides a very user friendly approach to accommodating the binding of books of different sizes without the need to rebuild dies in standard book binding case making machines, as is presently the common practice.

29 Claims, 4 Drawing Sheets

OPEN

CLOSED

CLOSED

OPEN

EXISTING ART

EXISTING ART

CASE MAKING DIES AND SYSTEMS, AND METHODS OF ADJUSTMENT, ALIGNMENT AND USE THEREOF

TECHNICAL FIELD

The present invention relates to case making systems such as applied in the automated formation of cover sheet-cardboard combination systems which comprise hard cover book bindings. More particularly the present invention is a self contained adjustable die system, and methods of adjustment, alignment and use thereof which allows user convenient means of sizing and alignment of said self contained adjustable size dies in case making systems.

BACKGROUND

Book binding companies typically produce hardback books with various sized cover-bindings, some of which books are produced in quantity runs of many thousands and some of which are produced in short quantity runs, (eg. less than six hundred copies). Said Hardback Book Cover-Bindings are typically produced with the aide of automation, with said automation being provided by "Case Making Systems".

A common problem associated with the use of such automated book binding producing "Case Making Systems" is that each size hardback book cover must be constructed using "dies" in said case making systems, which dies have been appropriately sized, adjusted and aligned. Typical available Book Binding case making systems commonly are provided with a multiplicity of die construction elements which can be combined and constructed into appropriately sized dies. However, end-user convenience has not been a primary concern of the companies providing such die construction elements. While, in the case where large quantity production runs of a single size hardback book cover is undertaken, the spending of many hours to construct dies of appropriate sizes, and mounting, adjusting and aligning them in a book binding case making system is typically acceptable, such is a serious source of lost profit when many short quantity hardback book cover binding production runs are undertaken.

The operation of hard cover book binding case making systems is generally described in the Disclosure of the Invention Section herein and will not be described here. However, briefly, operation of a hardcover book binding case making system involves the application of glue to the back side of a cover sheet, (that side opposite the side with identifying printing thereon), and the securing of, typically, three pieces of cardboard, (ie. corresponding to the Front and Back Covers, and the Spine of a book, in an appropriate configuration with respect to one another), to said glue coated side of said Cover Sheet. It is to be appreciated that the edges of said Cover Sheet are caused to wrap around the Top, Bottom, and Sides of the Three Pieces of cardboard, by said Case machine. Inspection of any typical hardbound book will provide insight to the end result.

What has not been known in the area of hardback book binding case making systems, or other case making systems for that matter is, a die system, and method of adjustment, alignment and use thereof, which allows an end user the ability to quickly and easily adjust die sizes and align said dies in existing case making systems.

A Search of Patents for appropriate case making systems with adjustable size dies and of methods of alignment and use thereof has provided U.S. Pat. No. 5,413,446 to Rathert et al.; U.S. Pat. No. 5,133,169 to Tesch Jr. et al., U.S. Pat. No. 4,863,331 to Torti, U.S. Pat. No. 4,764,073 to Garlichs et al., and U.S. Pat. No. 4,732,376 to Umezawa. While the Garlichs Patent does address the point of adjustable sizing of a machine utilized in binding of books, it is for a very different purpose than that addressed by the present invention. It is noted that none of said cited Patents are considered to be particularly relevant to the present invention, but are simply cited as being the closest know art.

There remains need for a die system and method of adjustment, alignment and use thereof, which allows an end user the ability to quickly and easily adjust die sizes and align said dies in existing case making systems.

DISCLOSURE OF THE INVENTION

To understand the present invention it is beneficial to understand that, for demonstration purposes, Case Making Systems, as utilized in the area of Book Binding for instance, do a number of things. They position a Cover-Sheet, (typically with printing on one side thereof), so that it rests upon a Bottom Die therein, after applying a film of glue to the back-side of said Cover-Sheet, such that the glue is accessible. (In the following it will be assumed, to aide description, that accessibility infers that the glue on the back-side of a Cover-Sheet is facing upward. It is to be understood that this is not a limiting orientation of the present invention, however). Continuing, Book-Binding Case Making Systems then serve to apply, for instance, Three Pieces of Cardboard to said glue covered Back-side of said Cover Sheet, via use of a Top Die, which Three Pieces of Cardboard correspond to the eventual Book Front and Back Covers, and a Spine. (Note that one (1) or more, and not necessarily Three (3) pieces of cardboard might be utilized in various applications). Typical Book-Binding Case Making Systems accomplish this result by Raising and Rotating the Top Die into a position where it can "Pick-Up" the Three Pieces of Cardboard, cause said Three Pieces of Cardboard to be Picked-Up, typically by a Suction mediated Effect, then Rotating Back and Lower so that said Three Pieces of Cardboard are appropriately placed upon said accessible glue covered Back-side of said Cover Sheet. Next, with the Three Pieces of Cardboard so "Sandwiched" in place, a Book-Binding Machine acts to cause the outer edges of the Cover Sheet to wrap around the outer edges of the Three Pieces of Cardboard, first at the Top and Bottom, and then at the Sides, (or perhaps in the reverse order or even perhaps simultaneously). It does this by lowering the described system into a "Well", which is formed from "Well" forming elements, which "Well" has inner dimensions just slightly large than the Bottom Die 50 that said Bottom Die can easily slide thereinto, and then causing extendable/retractable "Fingers" to extend from the sides of the Book-Binding Machine "Well" forming elements, and over the upper surface of the outer edges of the Bottom Die. (Note that the "Fingers" can be continuous bars). It is noted that said extendable/retractable Fingers from one "Well" forming element project toward another, typically parallel directed, "Well" forming element when extended. The Bottom Die is then caused to rise so that an upper surface thereof makes Flush Contact with the lower surfaces of said projected "Fingers". It will be appreciated that said described operation, perhaps performed twice, will serve to secure the "Two Sides" and the "Top and Bottom" edges of the Cover Sheet to the edges of the Three Pieces of Cardboard at the then downward facing glue covered surface of said Cover Sheet, with the glue serving to secure the resulting configuration. Note that typically there are two "Wells" present, (one positioned vertically above the other), and two sets of extendable/retractable "Fingers". One "Well" and associated extendable/retractable Set of "Fingers" can be appropriately positioned to secure "Sides" and the other "Well" and associated extendable/retractable Set of "Fingers" can be appropriately positioned to secure the Top and Bottom edges of a Cover Sheet to the outer edges of the Three Pieces of Cardboard. Assuming proper Bottom Die and "Finger" alignments, the Cover Sheet edges, it can be visualized, can be caused to wrap around the Three-Pieces of Cardboard, and be secured into an assembly by said glue, by said described action. (Note that the Top Die is of smaller outer Dimensions, such as ⅝ inch on a side, so that top surface of Cardboard Edges are made accessible).

The assembled Cover Sheet and Three pieces of Cardboard System is then released by the "Picker-Head and its associated vacuum system, leaving the assembly on the Bottom Die. The assembly is then transferred to, and caused to go through, a System, (such as a system comprised of closely situated top and bottom rollers which allows entry of the assembled Cover Sheet and Three pieces of Cardboard therebetween, for instance). Passage through said system serves to force Air Bubbles out and effect a smoothly Secured Cover-Sheet—Cardboard System, in which the Cardboard pieces are properly oriented.

Now, existing Book Binding Case Making Systems in general require that "Dies" set to do one run must be dismantled and reconstructed at each process element, (eg. Book-size), change. Such a change can involve a Book length or height change, for instance. Said dismantling and reconstruction comprises a typical size "adjustment" procedure. It should be understood that such a procedure is very inconvenient.

In addition, alignment of the Bottom Die with respect to the Projecting "Fingers", and adjustment of the Top and Bottom Dies so that Flush Contact occurs between facing surface areas thereof in use, is very difficult in existing Book Binding Case Making Systems. Typical practice is to mount specially reconstructed Bottom and Top Dies of appropriate outer Dimensions into a Book Binding Case Making System, and then apply "Tape", for instance, to various portions of the effectively contacting facing surfaces of said Top and Bottom Dies to effect uniform contact therebetween when the lower Surface of the Top Die is caused to lower and sandwich a Cover Sheet and Three Pieces of Cardboard therebetween. That is, the Alignment procedure for alligning the Top and Bottom Dies in typical existing Book Binding Case Making Systems is of a "Hit and Miss", "Try and Retry" variety. This might be acceptable in large runs of a single size book, but is extremely inconvenient where many small runs of books of different sizes are required. Such, to the Inventor's knowledge, is generally the case in all Case Making Systems, emphasis added.

Problems which exist in the use of typically available Book Binding Case Making Systems then, are that reconstructing the Bottom and Top stages of appropriate sizes for variously sized books requires major effort, and available equipment provides no means by which to easily, by a standard series of set steps, properly align Top and Bottom Dies in a Book Binding Case Making System, assuming that they are constructed to be of appropriate sizes. Book Binding Companies make and provided many elements from which one can construct appropriately sized Bottom and Top Dies, but said elements do not comprise self-contained "Adjustable-Size" Dies.

The present invention comprises self contained Adjustable Size Top and Bottom Dies which mount into existing Case-Making, (eg. Book-Binding) Systems, and a method for easily accomplishing Self-Alignment between contacting facing surfaces, (in use), of said Top and Bottom Dies when they are placed into and properly aligned within an existing Case Making System. In particular the present invention does not require that a time consuming "Hit and Miss" alignment procedure be performed.

In the most general terms, the present invention comprises Case Making System Top and Bottom Dies, at least one of which Top and Bottom Dies is adjustable in overall outer dimensional size. This can be by, for instance, adjustment of right, left, front, back, left corner and/or right corner elements with respect to a central element, said adjustment being achieved by positioning said right, left, front and back elements with respect to said central element by relative positioning along various extendable means.

A particular usage of the present invention is in book binding, where in use, a Case Making System serves to provide a cover sheet with glue affixed to the back side thereof at said bottom stage such that said glue covered back side faces away from said bottom stage; which Case Making System further serves to position, typically but not necessarily, three pieces of cardboard, corresponding to front and back covers of a book, and the spine thereof, in contact with said glue covered back side of said cover sheet, in proper orientation to one another to form a book, by means of a Top Die, which Top Die is caused to rotate and acquire said three pieces of cardboard, secure said three pieces of cardboard by suction means, then rotate to position said three pieces of cardboard above said glue covered back of said cover sheet, then lower to place said three pieces of cardboard in contact with said glue covered back of said cover sheet, then release said three pieces of cardboard by cessation of said suction.

In addition, the present invention also comprises methods for aligning the Top and bottom Dies and for causing said Top and Bottom Dies to reversibly approach and contact one another in use. To understand said alignment method it is necessary to understand that Case Making Systems can further comprise "Well Forming" elements, which well forming elements can be adjusted so as to provide a well of overall dimensions just in excess of the overall outer dimensions of said Bottom Die, and which well forming elements further provide extendable/retractable fingers which can be caused to project from and retract into said well forming elements as desired by a user. Said Case Making System is aligned for use by providing a Bottom Die to said Case Making System which Bottom Die comprises a Bottom Die, adjustable length, central pivot element such that said Bottom Die central pivot element contacts an underlying surface of said Case Making System. The Bottom Die further comprises means for securing a position of said Bottom Die when it has been appropriately caused to pivot about said Bottom Die central pivot element, into an aligned position with said Bottom Die and well forming elements which are adjusted so that the well forming elements are separated by a distance which allows said Bottom Die to be lowered thereinto when said extendable/retractable fingers are retracted into said well forming elements but not when they are extended. Said Method comprises causing said extendable/retractable fingers to be retracted into said well forming elements; causing said Bottom Die to be lowered into said well formed by said well forming elements to a point where an upper surface thereof is below the location at which said extendable/retractable fingers are located, causing said extendable/retractable fingers to be extended above said upper surface of said Bottom Die; causing said Bottom Die to rise so that edges of an upper surface thereof makes contact with lower extents of said extended fingers, and so that said Bottom Die pivots about said Bottom Die central pivot element such that essentially uniform contact between edges of said upper surface of said Bottom Die and the lower extents of said extended fingers is achieved; and operating the means for securing a position of said Bottom Die when it has been appropriately caused to pivot about said Bottom Die central pivot, into an aligned position, to secure said Bottom Die in the position so achieved. In essence this allows the Bottom Die to square itself parallel to the bottom of the extendable Fingers, assuring equal pressure along peripheral contacting surfaces.

The method of the present invention further comprises providing a Top Die to said Case Making System, which Top Die comprises an extendable Top Die central pivot element such that said Top Die central pivot element contacts an overlying surface of said press machine. The Top Die further comprises means for securing a position of said Top Die when it has been appropriately caused to pivot about said extendable Top Die central pivot element, into an aligned position. Said Method comprises causing said Top Die to lower such that a lower surface thereof which faces the upper surface of said Bottom Die is caused to essentially uniformly contact said upper surface of said Bottom Die, the edges of which upper surface of the Bottom Die were previously made to contact lower extents of said fingers when said fingers were extended from said well forming elements, so that said Bottom Die pivoted about its central pivot such that essentially uniform contact between edges of said upper surface of said Bottom Die and the lower extents of said extended fingers was achieved. Said Method further comprises operating the means for securing a position of said Top Die when it has been appropriately caused to pivot about its central pivot, into an aligned position, to secure said Top Die in the position so achieved. (Note, adjustment of the length of the extendable center pivot allows control of forces applied between the Bottom Die and the points of contact with said upper surfaces of said Fingers).

The present invention can be described as a Case Making System comprising Top and Bottom Dies which Case Making System comprising means for connecting a Top Die and a Bottom Die therein such that in use facing surfaces of said Top and Bottom Dies can be caused to come into essentially uniform contact with one another in which the means for connecting a Die therein comprises a quick release coupler.

Primarily however, the present invention is an adjustable size Die for use in Case Making Systems, the overall outer dimensional size of which is adjustable, by for instance, the adjustment of right, left, front, back, left corner and right corner elements with respect to a central element, said adjustment being achieved by positioning said right, left, front and back elements with respect to said central element by relative positioning along extendable means, and by positioning of said left corner element with respect to left and front elements along extendable means, and by positioning of said right corner element with respect to said right and front elements along extendable means. It should then be appreciated that no elements must be added or removed from a present invention Die to adjust its size or to effect surface area consistency, flatness and parallelism.

A preferred embodiment of the present invention will be better understood and appreciated by reference to the detailed Description Section of this Disclosure in conjunction with the Drawings.

SUMMARY OF THE INVENTION

It is a purpose of the present invention to provide an improved, end user convenient to use, adjustable size die for use in case making systems, such as those used in the production of hard cover book bindings.

It is a another purpose of the present invention to provide a method of alignment and use of adjustable size dies in case making systems, such as those used in the production of hard cover book bindings.

It is yet another purpose of the present invention to provide an adjustable size die which retains dimensional stability and strength throughout its range of size adjustability and which is infinitely adjustable within its maximum size range.

It is still yet another purpose of the present invention to provide an adjustable size die for use in case making systems which can retain fixed corners throughout its range of size adjustability.

It is yet still another purpose of the present invention to provide a system design which allows easy connection and disconnection of an adjustable size die to and from a case making system and which can be easily retrofit to existing case making systems, such as those used in the production of hard cover book bindings.

It is another purpose of the present invention to provide an adjustable size die for use in case making systems which maintains constant weight and element surface area, as well as maintaining flatness, squareness and parallelism throughout the range of overall dimension sizes effected by adjustment thereof.

It is yet another purpose of the present invention to provide adjustable size dies for use in case making systems which do not require the use of tape or shims and the like to effect alignment thereof in a case making system.

It is still yet another purpose of the present invention to provide adjustable size dies for use in case making systems which provide integrally incorporated suction means, the location of which require no modification during alignment of said adjustable size die in a case making system.

It is yet still another purpose of the present invention to provide adjustable size dies for use in case making systems which can utilize self-centering three point contact between securing system elements and size expansion effecting elements.

It is still yet another purpose of the present invention to provide a system which allows die height change adjustment to allow user increase or decrease of compressive forces achieved between dies present in a case making system in use.

It is another purpose of the present invention to provide a die which can be adjusted while present in a case making system, which die requires no external elements be added thereto effect said adjustment.

BRIEF DESCRIPTION OF THE DRAWINGS

FIG. 5*b* shows the edges of a Cover Sheet wrapped around the outer Dimensions of Three Pieces of Cardboard, (eg. Cover, Back and Spine).

DETAILED DESCRIPTION

From the following it should be appreciated that the present invention provides an improved, end user friendly and convenient to use, adjustable size Die for use in Case Making Systems, such as those used in the production of hard cover book bindings. The present invention provides an adjustable size Die which retains dimensional stability and strength throughout its range of size adjustability and which is infinitely adjustable within its maximum size range. The present invention, in its preferred embodiment, also provides an adjustable size Die for use in Case Making Systems, which adjustable size retains fixed corners throughout its range of size adjustability. The present invention further provides a system design which allows easy connection and disconnection of adjustable size Dies to and from a Case Making System and which can be easily retrofit to existing Case Making Systems. In addition, the present invention provides an adjustable size Die for use in Case Making Systems which adjustable size Die maintains constant weight and element surface area, as well as surface flatness, squareness and parallelism throughout the range of overall dimension sizes effected by adjustment thereof. The present invention also provides adjustable size Dies for use in Case Making Systems which do not require the use of tape or shims and the like to effect alignment thereof in a Case Making System. The present invention also provides adjustable size Dies for use in Case Making Systems which provide integrally incorporated fixed die element location suction means, the location of which require no modification during alignment of said adjustable size Die in a Case Making System. The present invention further preferably provides adjustable size Dies for use in Case Making Systems which utilize self-centering three point contact, (see FIG. 1*b*), between securing system elements and size expansion effecting Extendable Elements. The present invention also provides methods of alignment and use of adjustable size Dies in such Case Making Systems.

It is noted, that for demonstration purposes, a Book-Binding Case Making System will be utilized in the following disclosure, however, this is not to imply any limitations upon the Adjustable Dies per se. of present invention.

Figure 1A:
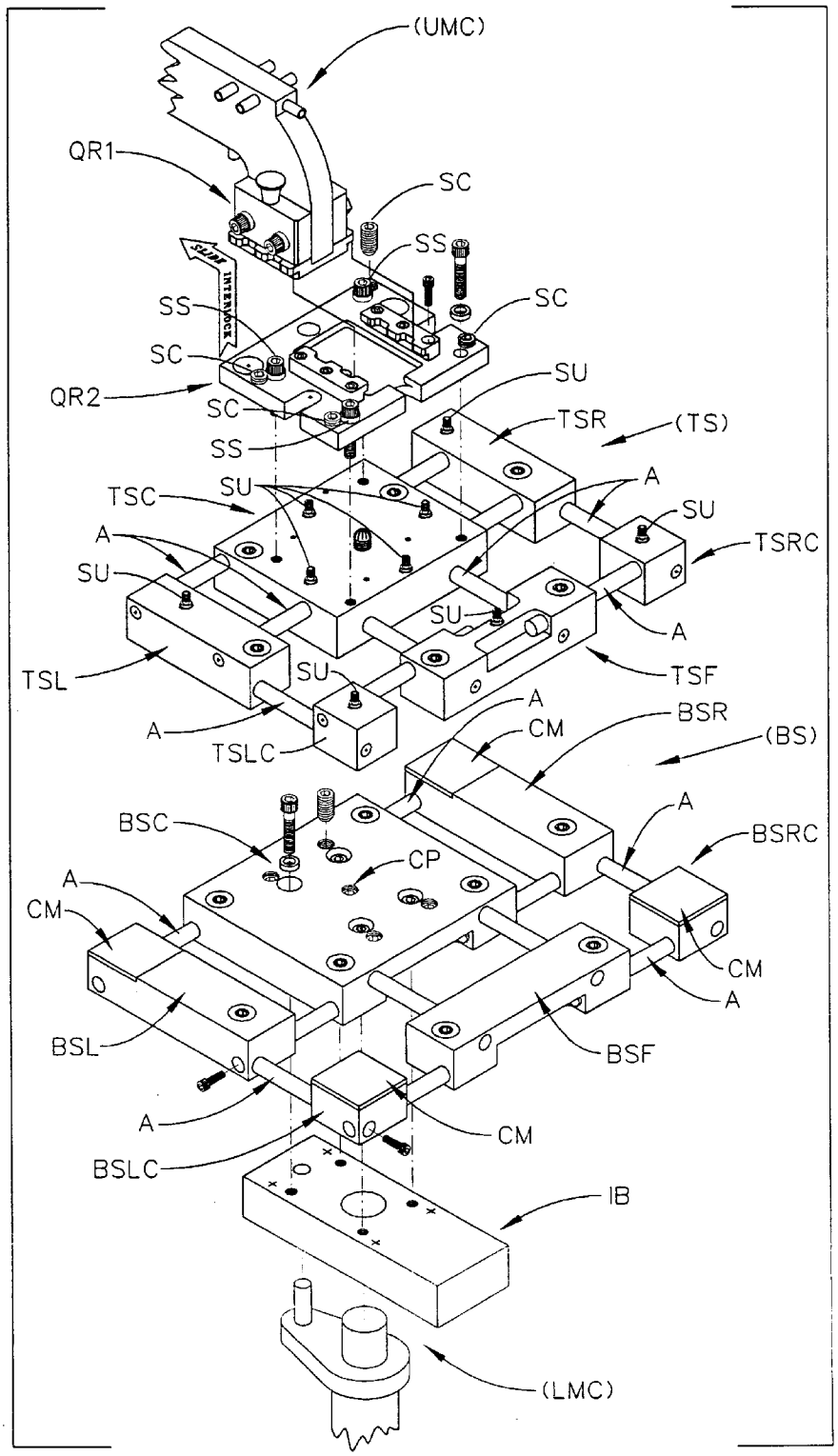
FIG. 1*a* shows an exploded view of a Case Making System Casting, a present invention Top Die and Top Die Quick Release Means, a present invention Bottom Die and Bottom Die Quick Release Means, and a Lower Case Making System casting.

Turning now to FIG. 1*a*, there is shown an Existing Book-Binding Case Making System (BBM) Casting (UMC), to which is affixed a First Quick Release (QR1) Element. A Second Quick-Release (QR2) Element is shown which interfaces with (QR1) in a manner which allows easy user effected connection and disconnection therebetween. While the specific design of said Quick Release Elements (QR1) and (QR2) is not a focus of the invention, the functional presence of said Quick Release Elements provides utility in the form of end user convenience. Now, the Second Quick Release Element (QR2), in use, is shown to be secured to a present invention Top Die (TS). Said present invention Top Die (TS) is also termed a "Picker-Head" as, in use, it serves to raise and rotate to a position at which is located, for instance, Three-Pieces of Cardboard, (which correspond to the Front (FC), Back (BC) and Spine (SP) of a book), "Pick-Up" said Three pieces of Cardboard and then rotate and lower so that said Three Pieces of Cardboard are placed onto a glue covered, typically upward facing, back of a Book Cover Sheet (CS) positioned atop Bottom Die (BS), said positioning being effected by other Book-Binding System (BBM) means. As mentioned infra, easy connection and disconnection of adjustable size Dies to and from a Case Making System and easy retrofit to existing Case Making Systems is thus enabled. It is noted that Suction Attachment Means (SU) are utilized to cause the Cover Sheet (CS) and to be secured to said Top Die (TS). Optionally, suction Attachment Means (SU) can be present to hold the Three Pieces of Cardboard, (Front (FC), Back (BC) and Spine (SP)), at the Bottom Die (BS) during the described operation. Note also that present invention Bottom Die (BS) is secured to a Lower System Casting (LMC) via Interface Block (IB). The Bottom Die (BS) can be termed a "Platform" because, as described, the Cover Sheet, with printing in contact therewith and with the glue covered side accessibly facing away therefrom, rests thereupon in use. Note that the presence of the Interface Block (IB) allows easy connection and disconnection of the Bottom Die (BS) from the Lower Book Binding System (BBM) Casting (LMC).

Figure 1B:
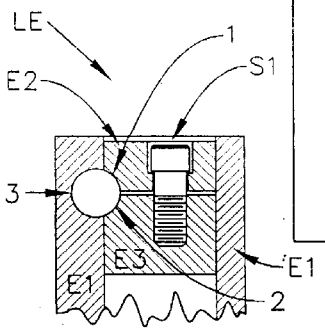
FIG. 1*b* shows a self-centering three-point securing means for securing present invention Extendable Means (A).
Figures 2A, 2B:
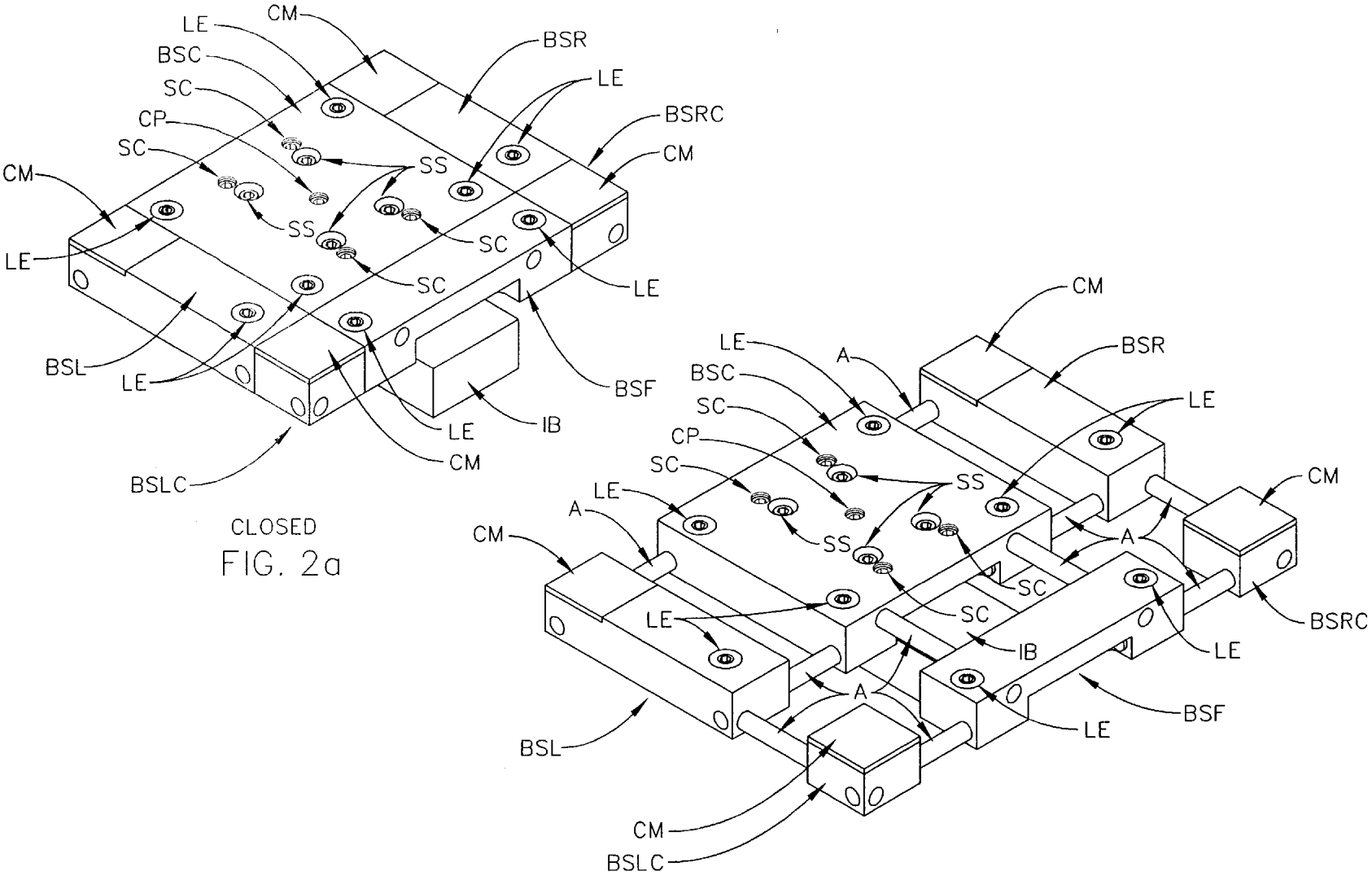
FIGS. 2*a* and 2*b* show a Preferred Embodiment of a present invention Bottom Die in closed and open configurations respectively.
Figures 3A, 3B:
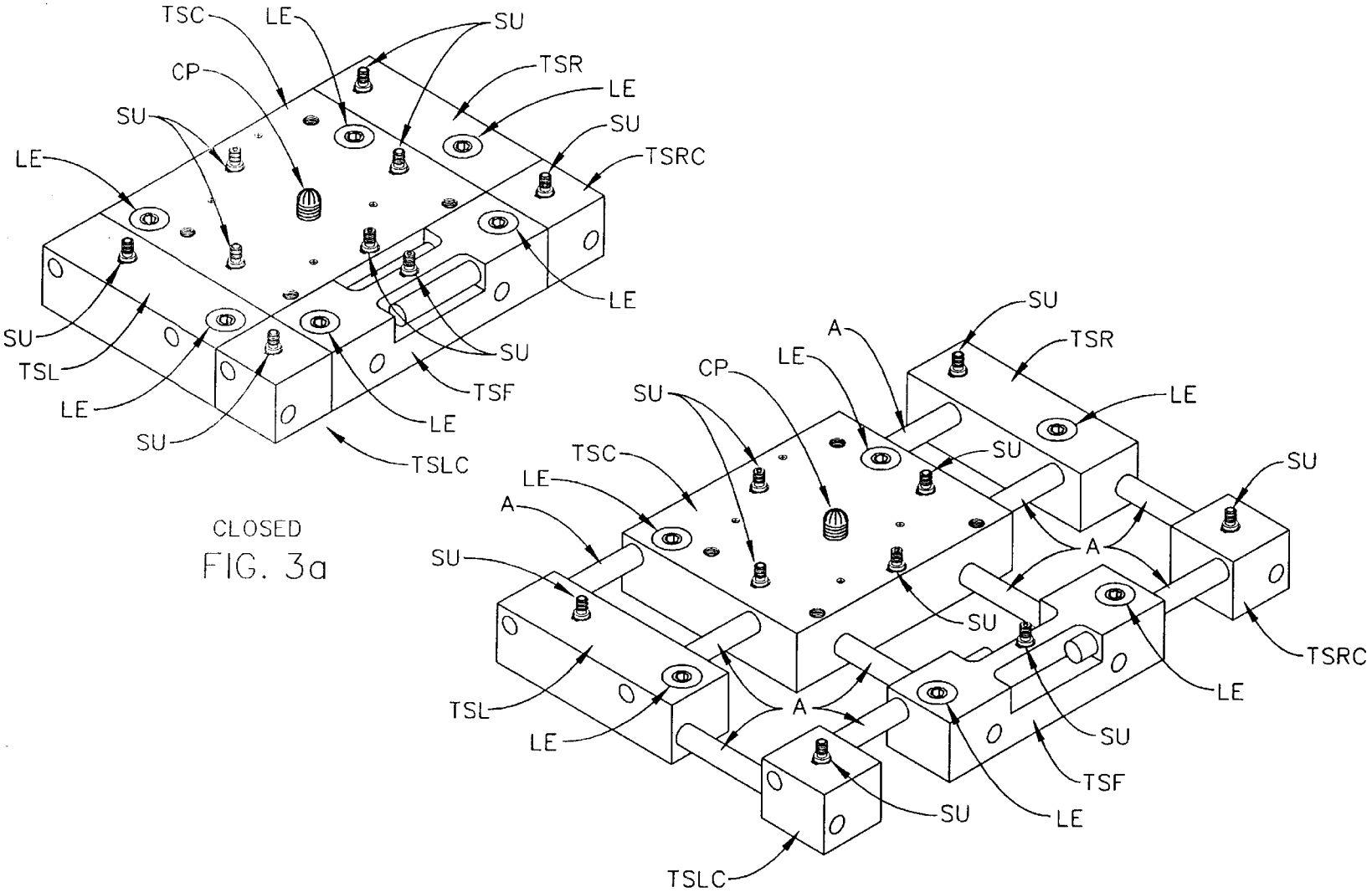
FIGS. 3*a* and 3*b* show a Preferred Embodiment of a present invention Top Die in closed and open configurations respectively.

Now, FIG. 1*a* also shows that a number of Extendable Means (A), (typically rods with circular cross-sectional areas, but not limited thereto), are present which allow Top (TS) and Bottom Die (BS) Overall Outer Dimensions to be adjusted. See FIGS. 2*a* and 2*b*, and 3*a* and 3*b* for Closed and Open Bottom (BS) and Top Die (TS) configurations respectively. FIGS. 2*a* and 2*b* show Bottom Die Right (BSR), Bottom Die Left (BSL), Bottom Die Forward (BSF), Bottom Die Left Corner (BSLC), Bottom Die Right Corner (BSRC) and Bottom Die Central (BSC) elements which are positioned with respect to one another via Extendable Means (A). FIGS. 3*a* and 3*b* show Top Die Right (TSR), Top Die Left (TSL), Top Die Forward (TSF), Top Die Left Corner (TSLC), Top Die Right Corner (TSRC) and Top Die Central (TSC) elements which are also positioned with respect to one another via other Extendable Means (A). Note that various shown Extendable Means (A) project between and into Die elements which are interconnected thereby. Within a Die element said Extendable Means (A) are secured by securing means, such as that demonstrated in FIG. 1*b*. FIG. 1*b* shows that Extendable Means (A) in Top (TS) and Bottom (BS) Dies are preferrably affixed to Central Die Elements ((TSC) and (BSC), as appropriate), by stabilizing Three-Point Contact, said Three-Point Contact being secured by tightening screws. Extendable Means (A) are similarly preferably secured to the Right and Left Side and Front elements, (ie. (TSR), (TSL), (TSF), (BSL), (BSR) and (BSF)). Said Three-Point Contact is an important aspect in enabling effecting coplanar parallelism amongst surfaces of Die Elements separated by various size adjustment lengths along Extendable Means (A), in use.

FIG. 1*b* shows an exemplary circular, (in cross-section), extendable means "A" secured via screw (S1) within a space formed between element (E1), element (E2) and element (E3) at three securing points (1), (2) and (3) of contact, (ie. Three-Point contact is effected between a Die Element and an Extendable means at the locus of contact therebetween). Note that element (E3) has mating threads into which screw (S1) can be turned, and that screw (S1) has a head which contacts element (E2). It will be appreciated then, that tightening screw (S1) will force element (E2) and (E3) together, and via contact with rod (3) at points (1) and (2), force said rod (3) to move laterally and contact element (El)

at point (3). The elements (E1), (E2), (E3) and screw (S1) comprise a Lock Element (LE) combination system, which is generally identified in other Drawings. As mentioned infra, adjustable size Top (TS) or Bottom (BS) Dies as described retain dimensional stability and strength, are infinitely adjustable within their maximum size ranges, and retained fixed corners throughout their ranges of size adjustability in use. In addition surface flatness, squareness and parallelism are maintained throughout the range of overall dimension sizes effected by the described size adjustment in use. The use of Three-Point Contact securing means is a particularly appropriate via for achieving said end result as it prevents damage to Extendable Means (A) secured thereby, unlike a single point set screw approach as commonly utilized in mechanical systems. Three-Point Contact is also very well suited for use in effecting coplanar parallelism between Die Elements over a large range of size adjustment.

FIGS. 3*a* and 3*b* serve to make it clear that the described Top (TS) Die is comprised of Top Die Left, (TSL), Top Die Right (TSR), Top Die Front (TSF), Top Die Right Corner (TSRC), Top Die Left Corner (TSLC) and Top Die Center (TSC) elements, which elements are interconnected by various Extendable Means (A), and which Top Die (TS) can be caused to be of various overall dimensional sizes. As viewed in perspective from the atop and in front thereof the Top Die Center (TSC) is seen interconnected to said Top Die Left (TSL), which is located to the left of said Top Die center (TSC), by means of two Extendable Means (A). Top Die Center (TSC) is also shown as interconnected to Top Die Right (TSR), which is located to the right of said Top Die Center (TSC), by two Extendable Means (A). Top Die Center (TSC) is also shown interconnected to Top Die Front (TSF), which is located in front of said Top Die Center (TSC), by two Extendable Means (A). As well, Top Die Left Corner (TSLC) is shown interconnected to Top Die Left (TSL) by one Extendable Means (A) and to Top Die Front (TSF) by one Extendable means, said Top Die Left Corner (TSLC) being located in front of said Top Die Left (TSL) and to the left of said Top Die Front (TSF); and Top Die Right Corner (TSRC) is shown interconnected to Top Die Right (TSR) by one Extendable Means (A) and to Top Die Front by one Extendable Means (A), said Top Die Right Corner being located in front of said Top Die Right (TSR) and to the right of said Top Die Front (TSF). In the central region of upper surface of the Top Die Center (TSC) is located the Top Die Center Pivot (CP), (which is typically, but not necessarily, extendable in length). Said Top Die Center Pivot (CP) is shown to project essentially perpendicularly to the plane of the surface of said Top Die. Also shown are a multiplicity of Suction Attachment Means (SU), four being located on the Top Die Center (TSC) and one each being on each of the (TSL), (TSR), (TSP), (TSLC) and (TSRC). Various securing means are also shown as present for fixing said Top Die (TS) to the Quick Release means (QR1) and (QR2), in a desired position, after the alignment procedure described infra has been carried out, (see FIG. 1*a* (SS) and (SC)).

FIGS. 2*a* & 2*b* serve to make it clear that the Bottom (BS) Die is comprised of Bottom Die Left, (BSL), Bottom Die Right (BSR), Bottom Die Front (BSF), Bottom Die Left Corner (BSLC), Bottom Die Right Corner (BSRC), and Bottom Die Center (BSC) elements, which elements are interconnected by various Extendable Means (A), and which Bottom Die (BS) can be caused to be of various overall dimensional sizes. As viewed in perspective from atop and in front thereof Bottom Die Center (BSC) is seen to be interconnected to said Bottom Die Left (BSL), which is located to the left of said Bottom Die Center (BSC), by means of two Extendable Means (A). Bottom Die Center (BSC) is also shown as interconnected to Bottom Die Right (BSR), which is located to the right of said Bottom Die Center (BSC), by two Extendable Means (A). Bottom Die Center (BSC) is also shown interconnected to Bottom Die Front (BSF), which is located in front of said Bottom Die Center (BSC), by two Extendable Means (A). As well, Bottom Die Left Corner (BSLC) is shown as interconnected to Bottom Die Left (BSL) by one Extendable Means (A) and to Bottom Die Front (BSF) by one Extendable means, said Bottom Die Left Corner (BSLC) being located in front of said Bottom Die Left (BSL) and to the left of said Bottom Die Front (BSF); and Bottom Die Right Corner (BSRC) is shown as interconnected to Bottom Die Right (BSR) by one Extendable Means (A) and to Bottom Die Front by one Extendable Means (A), said Bottom Die Right Corner (BSRC) being located in front of said Bottom Die Right (BSR) and to the right of said Bottom Die Front (BSF). In the central region of upper surface of the Bottom Die Center (BSC) is located the Bottom Die Center Pivot (CP), (which is typically, but not necessarily, extendable in length). Bottom Die Center Pivot (CP) projects essentially perpendicular to the surface of said Bottom Die. As well, Compressible Means (CM) are shown as present on the upper surfaces of the (BSLC) and (BSRC), as well as on the upper surface of the rearward most corners of the (BSR) and (BSL) elements. Various Securing Means (SS) are also shown as present for fixing said Bottom Die (BS) to the Interface Block (IB), in a desired position, after the alignment procedure described infra has been carried out. Said Securing Means (SS) can comprise three (3) extendable length projecting elements suitable for securing the position of said Bottom Die, even where a Center Pivot (CP) is not present. (Note, this applies equally to the Top Die). Also, while not shown, Suction Attachment Means (SU) can be present on the Bottom Die Center (BSC) and one each being on each of the (BSL), (BSR), (BSF), (BSLC) and (BSRC) elements. (It is noted that it is possible to eliminate Center Pivot (CP) means and utilize a minimum of three (3) Securing Means (SS) to effect alignment of a Die in the context of either a Top or Bottom Die).

Also note, in FIGS. 2*a* & 2*b* for instance, that Compressible Material (CM) is present at the Corners of the Bottom Die (BS). Said presence has been empirically found to be necessary because when Sides and Top or Bottom wrap around Cardboard, double thickness of Cover Sheet material can appear at corners. Without the Compressible Material (CM) a good contact between the Cover Sheet and the Cardboard at the edges beyond the corners is not accomplished because a double layer of Cover Sheet (CS) forms at the corners and prevents the application of force between the Cover Sheet (CS) and the Three Pieces of Cardboard where only a single layer of Cover Sheet (CS) is present. The Compressible Material (CM) at the corners "gives" enough to overcome the problem. (Note that the Compressible Material (CM) could cover an entire Top Die (TS) and/or Bottom Die (BS) Edge and that the compressible functional aspect could be provided by springs between planar surface providing elements for instance).

Note that Suction Attachment Means (SU) are also shown in the Top (TS) Dies at various appropriate locations. In use Vacuum is applied thereto to secure, for instance, the Three Pieces of Cardboard in place as required. It is noted that as a Die size is adjusted, there is no requirement that the location of said Suction Attachment Means be changed. In existing Book Binding Systems a change in the overall dimensions of a Die generally requires complete reconstruction thereof, and restraints imposed by available Die Construction Elements often requires that relative Suction Attachment Means locations be modified when the size of a Die is changed. That is, because of Die Construction Element availability, constructed existing Book Binding Systems Dies typically position Suction Attachment Means (SU) based upon where they can be fit-in in the construction process thereof, rather than where they will provide the best performance.

It is noted that the Extendable Means (A) project essentially parallel to coplanar parallel surfaces of present Die Elements in general, and that Center Pivots (CP) project essentially perpendicular to the surface of Central (SC) Die Element, beyond a Depth Dimension perpendicular to said Surface. (Note, each Die Element presents with a depth dimension perpendicularly oriented with respect to said surface thereof, and that the Extendable Means (A) project into a volume provided thereby, which volume typically comprises Lock Elements (LE) which receive said Extendable Means (A)).

Figure 5A:
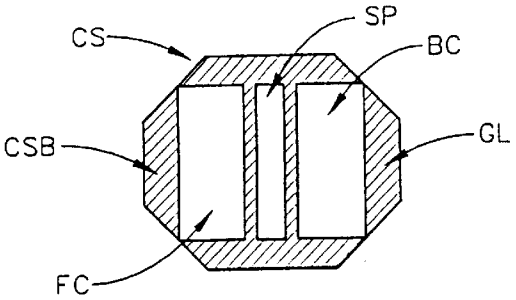
FIGS. 5*a* and 5*b* show a Cover Sheet and Three Pieces of Cardboard which can be assembled during operation of the present invention, before and after assembly, respectively.
Figure 5B:
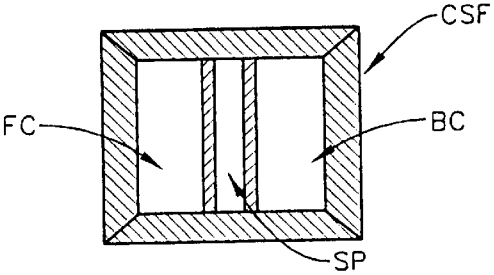
Figure 4B:
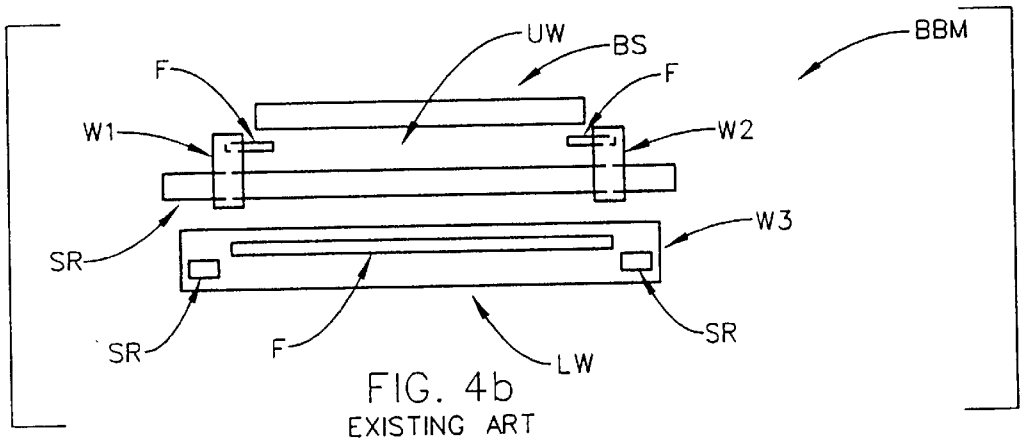
FIGS. 4*a* and 4*b* show typical existing "Case Making System" components of a typical Book Binding Case Making System.
Figure 4A:
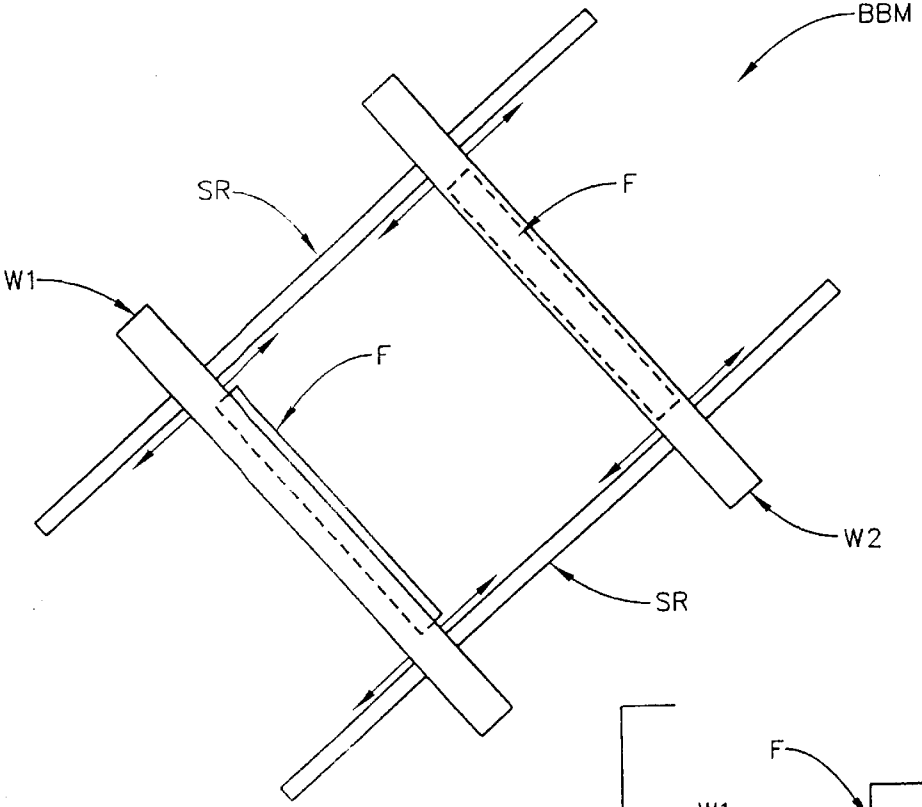

Turning now to FIGS. 4*a* and 4*b*, there are demonstrated existing Book Binding System (BBM) components. Note in FIG. 4*a* that Slide Rails, (SR) are shown upon which "Well" Forming elements (W1) & (W2) can, in use, be caused to slide to provide an intended separation therebetween. (It is noted that said intended separation relates to an overall Outer Dimension of a Book Cover). Note also the presence of retractable/extendable Fingers (F) in said "Well" forming elements (W1) & (W2), which retractable/extendable Finger elements can be caused to project from said "Well" forming elements (W1) & (W2) when desired by a user. It is to be noted that Fingers (P) in "Well" forming element (W1) project toward "Well" forming element (W2), and vice-versa when extended. Continuing, in use a Glue (CL) Covered Sheet Back (CSB) surface of a Cover Sheet (CS), with Three Pieces of Cardboard corresponding to Front Cover (FC), Back Cover (BC) and Spine (SP) of a Book, (see FIG. 5*a*), is sandwiched into contact with said Bottom Die (BS) by a contacting Top Die (TS), and the resulting System is caused to be lowered into a "Well", the sides of said "Well" being formed by "Well" forming elements (W1) & (W2) such as shown in FIG. 4*a*, which "Well" forming elements (W1) & (W2) serve to cause Glue Covered Cover Sheet Edges, (which extend past the outer dimensions effected by the combination of said Three Pieces of Cardboard (FC), (BC) & (SP)), to wrap upward approximately ninety (90) degrees, when said Bottom Die (BS) is caused to lower into said "Well". "Fingers" (F) are then caused to project from the sides of said "Well" forming elements (W1) & (W2). (Note that for demonstration purposes, said Fingers (F) are shown projected from the "Well" forming element at the left therein (W1), but are shown retracted in the "Well" forming element (W2) at the right therein in FIG. 4*a*. It is emphasized that in use the Fingers (F) will be retracted or extended in both "Well" forming elements simultaneously). With the Finger (F) elements projected from said "Well" forming elements (eg. (W1) & (W2)), and said Bottom Die (BS) is then caused to rise so that said "Finger" (F) elements in the Book-Binding System (BBM) "Well" forming elements (W1) & (W2), cause the edges of a Cover Sheet (CS) to wrap around the outer edges of the Three Pieces of Cardboard (FC), (BC) & (SP), such that flush, glue retained, contact at edges (ie. Top and Bottom or the Sides at the overall Outer Dimensions of the Three Pieces of Cardboard (FC), (BC) & (SP)), and the Cover Sheet (CS) is achieved. FIG. 5*b* shows such a configuration where (CSF) identifies the front surface of a Cover Sheet (CS), all edges of which have been wrapped around the outer dimensional edges of the Three Pieces of Cardboard (FC), (BC) and (SP) so that the glue covered back side of said Cover Sheet (CS) secures the Cover Sheet (CS) to the Three Pieces of Cardboard (FC), (BC) and (SP) at the outer dimensions thereof. (Note, to arrive at the configuration shown in FIG. 5*b* the described procedure is repeated with respect to a second "Well". One "Well" operates with respect to the Top and Bottom edges of the Cover Sheet (CS) and the second with respect to the Right and Left Sides thereof). FIG. 4*b* shows the identified elements of a Book Binding System (BBM) shown in FIG. 4*a* but with two "Wells" present, termed "Upper" (UW) and "Lower" (LW) "Wells" respectively. The Upper Well (UW) is shown positioned above the Lower Well (LW). A Bottom Die (BS) is shown positioned directly above said system of Upper (UW) and Lower (LW) "Wells" and is shown to be of overall Outer Dimensions appropriately adjusted such that said Bottom Die (BS) can easily be lowered into said Upper and Lower "Wells" when the Fingers (F) from each are retracted. (Note that a Lower Well (LW) forming element (W3) is shown at location of the Lower Well (LW). An additional "Well" forming element (W4), (not shown), will also be present directly in back of, (as viewed in FIG. 4*b*), Lower Well (LW) forming element (W3) to compliment the Lower Well forming element (W3) in a Book Binding Case Making System (BBM)). Again, note that the positions of Book-Binding Case Making System Upper Well forming elements (W1) & (W2) and Lower Well (W3), (and (W4) which is not shown), forming elements, from which the "Fingers" (F) can be caused to project in use, are user adjustable by sliding said "Well" forming elements (W1), (W2) and/or (W3) & (W4) (which is not shown), along appropriate Slide Rails (SR). It is also to be noted that a "Well" can be formed from (W1), (W2), (W3) and (W4) in which all said "Well" forming elements simultaneously provide Fingers which act on the wrapping of a Cover Sheet (CS) around the edges of the Three Pieces of Cardboard. That is, FIG. 4*b* would be modified to provide both "Well" forming elements on a single level.

Now, the present invention teaches that the Bottom (BS) and Top (TS) Dies of the present invention system should be properly aligned with the "Well" forming elements, ((W1), (W2), (W3) and (W4) not shown), of a Book Binding Case Making System (BBM) with which they are utilized, before said Book Binding System (BBM) is utilized in production of combined Cover Sheet-Three Pieces of Cardboard Systems. Prior proper alignment enables user friendly operation, which operation does not require any trial and error applications of tape or shims etc., as described in the Background Section of this Disclosure, regarding presently available Book Binding Systems, to achieve uniform Book Binding System (BBM) effected flush contact between facing surfaces of Top (TS) and Bottom (BS) Dies of the present invention in use.

The alignment procedure of the present invention requires that the Bottom Die (BS) and Top Die (TS) be properly positioned with respect to Book Binding Case Making System (BBM) elements. To adjust the Bottom Die (BS) so that it is properly aligned in a Book Binding Case Making System (BBM) prior to use thereof in forming Cover Sheet (CS) and Three-Piece Cardboard Systems, the overall Outer Dimensions of said Bottom Die (BS) are adjusted, (it is to be appreciated that the overall Outer Dimensions of the Bottom Die (BS) can be adjusted before or after positioning it into a Book Binding System (BBM)), via use of Extendable Means (A). That is, for example, the Right (BSL) and Left (BSL) Bottom Die Side elements and Bottom Die Front (BSF) element, as well as the Bottom Die Central element (BSC), are all caused to clamp appropriate Extendable Means (A) at desired locations therealong. Next, an associated extendable length Center Pivot (CP) of said Bottom Die (BS) is caused to pivotally rest upon the Interface Block (IB), (see FIGS. 2*a* and 2*b* for location of said Bottom Die (BS) Center Pivot (CP), which Bottom Die Center Pivot (CP) projects downward much as the Center Pivot (CP) of the Top Die (TS), shown in FIGS. 3*a* and 3*b* projects upward). Next the Bottom Die (BS) is caused to be lowered into a Book-Binding Case Making System "Well" of slightly larger dimensions. Said "Well" can be formed by the "Well" Forming elements (eg. (W1) & (W2)) of FIG. 4*b* for instance, while said Fingers (F) therein are retracted into said "Well" forming elements, (eg. W1) & (W2)). The Fingers (F) are then caused to project from said "Well" forming elements (eg. (W1) & (W2)), and said Bottom Die (BS) is then caused to rise so that said "Fingers" (F) in the Book-Binding System "Well" forming elements, (which in use cause the edges of a Cover Sheet to wrap around the outer edges of the Three Pieces of Cardboard), are in flush contact with said Bottom Die (BS) at edges (ie. Top and Bottom or the Sides of the Three Pieces of Cardboard). Set Screws (SC) are then adjusted to secure the pivoted position, which action is directly followed by Tightening Securing Screws (SS) to secure the Bottom Die (BS) Book Binding Case Making System (BBM) System as configured. It is noted that the Bottom Die (BS) can be adjusted as described utilizing Fingers (F) from the Upper Well (UW) and/or Lower Well (LW) forming elements, or by use of all said "Well" forming elements simultaneously, or by any other means, such as the use of indicators a user wishes to use. Known prior art does not provide for leveling as described to be practiced with the result that machine wear based non-alignment problems develop which can not be easily compensated.

The procedure for adjusting the Top Die (TS) is similar, but its extendable length Center Pivot (CP) rests upon a lower surface of the First Quick Release Element (QR1), and the Top Die (TS) positioning is accomplished by bringing it into contact with the previously Set Bottom Die (BS) such that said Top Die is caused to pivot about said Top Die (TS) Center Pivot (CP). Then Set Screw (SC) and Securing Means (SS) are utilized to fix its position. The Top Die (TS) alignment procedure is performed after the Bottom Die (BS) alignment procedure described above, hence its alignment serves to indirectly fully align the Top Die (TS) to the "Well" forming elements utilized during the alignment of the Bottom Die (BS).

It should then be appreciated that after performance of both Bottom Die (BS) and Top Die (TS) alignment procedures, all tolerances associated with the combined Book Binding Case Making System (BBM) and interconnected present invention Top (TS) and Bottom (BS) Dies are adjusted out, so that when facing surfaces of the Top Die (TS) and Bottom Die (BS) are brought into contact by a Book Binding Case Making System (BBM) Press operation, essentially uniform contact between said facing surfaces is achieved. As there is no need to apply, for instance, tape or shims to various portions of a Die surface, the present invention Dies maintain constant weight and surface area in use because no pieces have to be added or removed.

It should be appreciated that the above System and Adjustment Procedure provides Control over the overall size of the Top (TS) and Bottom (BS) Dies, and allows their positioning in an adjustable size Book Binding Case Making System (BBM) so that flush contact is made between Cover Sheets (CS) and the properly oriented Three Pieces of Cardboard (FC), (BC), & (SP) in use, at all overall Outer Dimension edges, and so that all Cover Sheet (CS) edges wrap around the overall Outer Dimensions provided by said edges of the Three Pieces of Cardboard. It is important to realize that within applicable ranges of use, extending the outer dimensions of Top (TS) and Bottom Dies (BS) does not serve to affect the integrity of the consistency of the planar nature of the facing surfaces of said Top and Bottom Dies (TS) & (BS) at their plane of contact, or squareness and parallelism of each. It should also be noted that the adjustment made to the Top Die (TS) and Bottom Die (BS) remain integral with each respective Die, are required to be performed only once and are independent of First Quick Release (QR1).

It is also to be appreciated that the present invention is applicable to use not only in Book-Binding Case Making Systems (BBM's), but any sort of "Case Making Systems", (eg. Packaging Systems), which serve to assemble pieces similarly to how the presently discussed Book-Binding Case Making System assembles Cover Sheets and pieces of Cardboard. In particular, one could utilize the disclosed approach to Alignment of Top (TS) and Bottom (BS) Dies in a System other than utilized in the binding of books.

It is also to be understood that a present invention Die could provide other than an overall rectangular shape and be within the scope of the present invention. For instance, Top or Bottom Die Front, Front, Left or Right Elements could provide curved outer perimeter shapes and Right and Left Corners eliminated, (as viewed in perspective or from below or above respectively when in position in a Case Making System as described above), and said Top or Bottom Dies could still comprise adjustable size Dies for use in Case Making Systems, which adjustable size Die maintains constant weight and element surface area, as well as surface flatness and parallelism throughout the range of overall dimension sizes effected by adjustment thereof. In addition, a Back Element, (not specifically shown but being similar to said Front Element and oriented as a mirror-image thereof with respect to said Central Element), could also be present. That is, a present invention Die is not limited to being generally rectangular in shape and providing Right and Left Corners, and could also comprise a Back Element. As well, any Plurality of Elements, (functionally similar to but other than those identified as Front, Back, Left and Right Elements), could be present and oriented with respect to a Central Element along extendable elements which project at other than ninety-degree angles with respect to one another. That is, Extendable Means need not project from a Central Element with ninety-degrees, or multiples of ninety-degrees therebetween.

It is also to be expressly understood that the present invention can comprise a user friendly convenient to use, self contained, adjustable size die, the overall outer dimensions of which are of an arbitrary shape, and of a size determined by the adjustment of the position of at least a first element with respect to a second element; said adjustment being achieved by the positioning of said first element by relative positioning along extendable means, which extendable means project from within each of said first and second elements. The important aspects being that each of said present elements comprises a surface area and that the adjustable size die retains dimensional stability and strength throughout its range of size adjustability, is infinitely adjustable within a maximum size range, and that said adjustable size die maintains constant weight and element surface area, as well as surface flatness and coplanar parallelism, throughout the range of overall dimension sizes.

It is also noted that the term "rod", where applied to describe an extendable means, can be other than circularly shaped in cross section.

It is also to be understood that the terminology "surface flatness" should be interpreted to mean that the surfaces of individual elements are typically flat to a nominal value of within a few thousandths of an inch. As well, the terminology "coplanar parallelism", (between surfaces of die elements interconnected by extendable means), should be interpreted to mean that surfaces of elements interconnected by extendable means are typically in the same plane to within better than one-sixteenth (1/16) of an inch, said one-sixteenth (1/16) inch value being that provided by typical existing book-binding system stage construction element interconnecting systems. In practice the present invention is capable of providing coplanarity on the order of within a few ten-thousandths of an inch.

It is also to be understood the terminology "maximum size range" refers to a maximum distance by which elements, interconnected by extendable means at lock means in die elements, can be separated by said extendable means, while retaining "coplanar parallelism" between the surfaces of said elements, and dimensional stability therebetween.

It is to be noted as well, that the terminology "Suction Attachment Means" can include means for accessing pneumatic type suction, or magnetic, for instance, securing means. As well, said Suction Attachment Means can be present on the Top (TS) Die and/or Bottom Die (BS).

It is also noted that "Compressible Material" can be present on the Top Die (TS) and/or the Bottom Die (BS), or not present.

It is further to be understood that the while terminology "Finger" as described infra in the context of Case Making Systems, (eg. Book Binding Systems), refers to an extendable element, simple alignment marks are within the scope of said terminology "Finger". For the purposes of Claim interpretation, where it is described infra herein that an Upper Surface of a Bottom Die is caused to contact a Lower Surface of Retractable Fingers, it is to be understood as including the case wherein the Upper Surface of a Bottom Die is simply positioned with Alignment Marks in the place of Retractable Fingers.

Having hereby disclosed the subject matter of the present invention, it should be obvious that many modifications, substitutions, and variations of the present invention are possible in light of the teachings. It is to be understood that the invention can be practiced other than as specifically described, and should be limited only by the Claims.

I claim:

1. A die comprised of die elements, each of which die elements comprises a surface area and a depth dimension perpendicular thereto; the overall outer dimensions of said die being of an arbitrary shape, and of a size determined by the adjustment of the position of at least a first die element with respect to a second die element; said adjustment being achieved by the relative positioning of present die elements along extendable means, said extendable means projecting from within one die element to within another die element, each in a direction parallel to the surfaces of present die elements; which die retains dimensional stability and strength throughout its range of size adjustability and is infinitely adjustable within a maximum size range, which die maintains constant weight and die element surface area, as well as surface flatness and coplanar parallelism amongst surfaces of die elements throughout the range of overall dimension sizes effected by adjustment without the required use of added tape or shims and the like.

2. A die as in claim 1, in which contact between a die element and an extendable means is by self-centering three point contact, at a locus of contact therebetween.

3. A die comprised of a plurality of die elements, each of which die elements comprises a surface area and a depth dimension perpendicular thereto; the overall outer dimensions of said die being of an arbitrary shape, and of a size determined by the adjustment of the position of at least one die element with respect to a central die element; adjustment being achieved by the relative positioning of said at least one die element, with respect to said central die element, along extendable means, said extendable means projecting from within a die element into a central die element, each in a direction parallel to the surfaces of said die elements; which die retains dimensional stability and strength throughout a range of size adjustability, and is infinitely adjustable within a maximum size range, which die maintains constant weight and die element surface area, as well as surface flatness and coplanar parallelism amongst surfaces of die elements throughout the range of overall dimension sizes effected by adjustment thereof without the required use of added tape or shims and the like, which die optionally provides integrally incorporated fixed die element location suction attachment means, and die element surface covering compressible material.

4. A die as in claim 3, which further comprises a central pivot means selected from the group consisting of fixed length and extendable length, said central pivot means being located essentially centrally in said central element and projecting essentially perpendicular with respect to the surface and beyond the depth dimension thereof.

5. A die as in claim 3, which further comprises securing means suitable for use in fixing said die in, for instance, positions of pivot around a central pivot means located essentially centrally in said central die element, said securing means comprising at least three adjustable projecting elements.

6. A die as in claim 3, in which contact between a die element and an extendable means is by self-centering three point contact, at a locus of contact therebetween.

7. A die as in claim 3, in which at least a part of the surface of at least one die element is covered with a compressible material.

8. A user friendly, convenient to use, self contained, adjustable size die comprised of a plurality of die elements, each of which comprises a surface area and a depth dimension perpendicular thereto; the overall outer dimensions thereof being of an arbitrary shape, and of a size determined by the adjustment of the position of at least one element selected from the group consisting of left, right, front and back die elements, with respect to a central element; said adjustment being achieved by positioning present die elements selected from the group consisting of right, left, front and back die elements, with respect to said central element, by relative positioning thereof along extendable means, said extendable means each projecting from within lock elements in said die elements selected from the group consisting of right, left, front and back die elements into lock elements within said central die element; each in a direction parallel to the surfaces of said die elements; which adjustable size die retains dimensional stability and strength throughout its range of size adjustability and is infinitely adjustable within a maximum size range, which adjustable size die maintains constant weight and element surface area, as well as surface flatness and coplanar parallelism amongst surfaces of die elements throughout the range of overall dimension sizes effected by adjustment thereof without the required use of added tape or shims and the like, which adjustable size die optionally comprises integrally incorporated fixed die element location suction attachment means, and die element surface covering compressible material.

9. A user friendly, convenient to use, self contained, adjustable size die as in claim 8, which further comprises a central pivot means selected from the group consisting of fixed length and extendable length, said central pivot means being located essentially centrally in said central element and projecting essentially perpendicular with respect to the surface and beyond the depth dimension thereof.

10. A user friendly, convenient to use, self contained, adjustable size die as in claim 8, which further comprises securing means suitable for use in fixing said user friendly convenient to use, self contained, adjustable size die in, for instance, positions of pivot around a central pivot means located essentially centrally in said central die element, said securing means comprising at least three adjustable projecting elements.

11. A user friendly, convenient to use, self contained, adjustable size die as in claim 8, in which contact between a die element lock element and an extendable means is by self-centering three point contact, at a locus of contact therebetween.

12. A user friendly, convenient to use, self contained, adjustable size die as in claim 8, in which at least part of the surface of at least one die element is covered with a compressible material.

13. A user friendly, convenient to use, self contained, adjustable size die comprised of a plurality of die elements each of which comprises a surface area and a depth dimension perpendicular thereto; the overall outer dimensions of which user friendly, convenient to use, self contained, adjustable size die are adjustable by the adjustment of the position of at least one die element selected from the group consisting of left, right, front, left corner and right corner die elements, with respect to a central die element; said adjustment being achieved by the positioning at least one present die element selected from the group consisting of right, left, front, left corner and right corner die elements, with respect to said central die element by relative positioning of die elements selected from the group consisting of at least the right, left, and front die elements along extendable means, which extendable means project from within lock elements in said die elements selected from the group consisting of at least the right, left and front die elements into lock elements in said central die element, each in a direction parallel to the surfaces of said die elements; which adjustable size die retains dimensional stability and strength throughout its range of size adjustability and is infinitely adjustable within a maximum size range, which adjustable size die allows for easy connection and disconnection to and from a system and can be easily retrofit to existing systems, which adjustable size die maintains constant weight and die element surface area, as well as surface flatness, squareness and coplanar parallelism amongst surfaces of die elements throughout the range of overall dimension sizes effected by adjustment thereof without the required use of added tape or shims and the like, which adjustable size die optionally comprises integrally incorporated fixed die element location suction attachment means and die element surface covering compressible material.

14. A user friendly, convenient to use, self contained, adjustable size die as in claim 13, in which contact between a die element lock element and an extendable means is by self-centering three point contact, at a locus of contact therebetween.

15. A user friendly, convenient to use, self contained, adjustable size die as in claim 13, in which at least a part of the surface of at least one die element is covered with a compressible material.

16. A user friendly, convenient to use, self contained, adjustable size die as in claim 15, in which the surface areas of the right and left corner die elements are covered with a compressible material.

17. A user friendly, convenient to use, self contained, adjustable size die as in claim 13, in which said user friendly convenient to use, self contained, adjustable size die is a top die and said surface is typically downward facing in use, in which the die left, right, front, left corner, right corner and said center die elements are respectively, top die left, top die right, top die front, top die left corner, top die right corner and top die center die elements; such that present die elements when viewed in perspective are oriented such that said top die center die element is interconnected to said top die left die element, to the left of said top die center die element, by means of at least two extendable means; and which top die center die element is also interconnected to top die right die element, to the right of said top die center die element, by at least two extendable means, and which top die center die element is also interconnected to top die front die element, in front of said top die center die element, by at least two extendable means, and which top die left corner die element is interconnected to top die left die element by at least one extendable means and to top die front die element by at least one extendable means, said top die left corner die element being located in front of said top die left die element and to the left of said top die front die element; and which top die right corner die element is interconnected to top die right die element by at least one extendable means and to top die front die element by at least one extendable means, said top die right corner die element being located in front of said top die right die element and to the right of said top die front die element; which adjustable size top die retains fixed shape corners throughout its range of size adjustability; in a central region of which top die center die element is located an upward projecting center pivot means which projects essentially perpendicular with respect to said typically downward facing surface and upward beyond the depth dimension of said top die center die element, which user friendly, convenient to use adjustable size die is further comprised of a multiplicity of Suction Attachment means located on die elements selected from the group consisting of the top die center, present top die left, top die right, top die front, top die left corner and top die right corner die elements.

18. A user friendly, convenient to use, self contained, adjustable size die as in claim 13, in which said user friendly convenient to use, self contained, adjustable size die is a bottom die and said surface is typically upward facing in use, in which the die left, right, front, left corner, right corner and said center die elements are, respectively, bottom die left, bottom die right, bottom die front, bottom die left corner, bottom die right corner and bottom die center die elements; such that present die elements when viewed in perspective are oriented such that said bottom die center die element is interconnected to said bottom die left die element, to the left of said bottom die center die element, by at least two extendable means, and which bottom die center die element is also interconnected to bottom die right die element, to the right of said bottom die center die element, by at least two extendable means, and which bottom die center die element is also interconnected to bottom die front die element, in front of said bottom die center die element, by at least two extendable means, and which bottom die left corner die element is interconnected to said bottom die left die element by at least one extendable means and to bottom die front die element by at least one extendable means, with said bottom die left corner die element being located in front of said bottom die left die element and to the left of said bottom die front die element; and which bottom die right corner die element is interconnected to bottom die right die element by at least one extendable means and to bottom die front die element by at least one extendable means, said bottom die right corner die element being located in front of said bottom die right die element and to the right of said bottom die front die element; which adjustable size bottom die retains fixed shape corners throughout its range of size adjustability; in a central region of which bottom die center die element is located a downward projecting center pivot means which projects essentially perpendicular with respect to said typically upward facing surface and down beyond the depth dimension of said bottom die center die element, which user friendly, convenient to use adjustable size die is further comprised of compressible material present over at least a portion of the surfaces of present die elements.

19. A method for aligning top and bottom dies in a system so that facing surfaces of said top and bottom dies make essentially uniform contact with one another when caused to make contact with one another by operation of said system, comprising the steps of:

a. providing a system comprising means for connecting a top die and a bottom die therein such that in use facing surfaces of said top and bottom dies can be caused to come into essentially uniform contact with one another, said system comprising means for causing said top and bottom dies to reversibly approach and contact one another; which system further comprises well forming elements, which well forming elements can be adjusted so as to provide a well of overall dimensions just in excess of the overall outer dimensions of said bottom die, and which well forming elements further provide extendable/retractable fingers which can be caused to project from and retract into said well forming elements as desired by a user;

b. providing a bottom die to said system which bottom die comprises a bottom die central pivot means such that said bottom die central pivot means contacts an underlying surface of said system, which bottom die further comprises means for securing a position of said bottom die when it has been appropriately caused to pivot about said bottom die central pivot means, into an aligned position;

c. causing said bottom die and well forming elements to be adjusted so that the well forming elements are separated by a distance which allows said bottom die to be lowered thereinto when said extendable/retractable fingers are retracted into said well forming elements but not when they are extended;

d. causing said extendable/retractable fingers to be retracted into said well forming elements;

e. causing said bottom die to be lowered into said well formed by said well forming elements to a point where an upper surface thereof is below the location at which said extendable/retractable fingers are located, and causing said extendable/retractable fingers to be extended above said upper surface of said bottom die;

f. causing said bottom die to rise so that edges of an upper surface thereof makes contact with lower extents of said extended fingers, and so that said bottom die pivots about said bottom die central pivot means such that essentially uniform contact between edges of said upper surface of said bottom die and the lower extents of said extended fingers is achieved;

g. operating the means for securing a position of said bottom die when it has been appropriately caused to pivot about said bottom die central pivot means, into an aligned position, to secure said bottom die in the position achieved in step f.

20. A method for aligning top and bottom dies in a system so that facing surfaces of said top and bottom dies make essentially uniform contact with one another when caused to make contact with one another by operation of said system, as in claim 19, which method further comprises the step of:

a. retracting said fingers into said well forming elements;

b. providing a top die to said system, which top die comprises a top die central pivot means such that said top die central pivot means contacts an overlying surface of said system, which top die further comprises means for securing a position of said top die when it has been appropriately caused to pivot about said top die central pivot means, into an aligned position;

c. causing said top die to lower such that a lower surface thereof which faces the upper surface of said bottom die is caused to essentially uniformly contact said upper surface of said bottom die, the edges of which upper surface of the bottom die were previously made to contact lower extents of said fingers when said fingers were extended from said well forming elements, so that said bottom die pivoted about its central pivot such that essentially uniform contact between edges of said upper surface of said bottom die and the lower extents of said extended fingers was achieved;

d. operating the means for securing a position of said top die when it has been appropriately caused to pivot about its central pivot, into an aligned position, to secure said top die in the position achieved in step c.

21. A system comprising top and bottom dies, at least one of which top and bottom dies is adjustable in overall outer dimensional size by the adjustment of at least one die element selected from the group consisting of left, right front, left corner and right corner die elements with respect to a central die element, said adjustment being achieved by positioning said left, right and front die elements to the left, right and front respectively, with respect to said central die element, by relative positioning thereof along various extendable means, and by positioning of said left corner die element with respect to left and front die elements along extendable means, and by positioning of said right corner die element with respect to said right and front die elements along extendable means.

22. A system comprising top and bottom dies as in claim 21, in which said extendable means comprises rods, which left, right and front elements of said adjustable size die are caused to be placed with respect to said central die element by clamping means.

23. A system comprising top and bottom dies as in claim 22 in which said clamping means provide three point self centering contact to said rods.

24. A system comprising top and bottom dies as in claim 21; in which the system is a book binding system which in use serves to provide a cover sheet with glue affixed to the back side thereof at said bottom die such that said glue covered back side faces away from said bottom die; which book binding system further serves to position at least one piece of cardboard, corresponding to a front cover, a back cover of a book, and a spine thereof, in contact with said glue covered back side of said cover sheet, in proper orientation to form a book, by means of a top die, which top die is caused to rotate and acquire said at least one piece of cardboard, secure said at least one piece of cardboard by suction means, then rotate to position said at least one piece of cardboard above said glue covered back of said cover sheet, then lower to place said at least one piece of cardboard in contact with said glue covered back of said cover sheet, then release said at least one piece of cardboard by cessation of said suction.

25. A system comprising top and bottom dies comprising means for connecting a top die and a bottom die therein such that in use facing surfaces of said top and bottom dies can be caused to come into essentially uniform contact with one another, said system comprising means for causing said top and bottom dies to reversibly approach and contact one another; which system further comprises well forming elements, which well forming elements can be adjusted so as to provide a well of overall dimensions just in excess of the overall outer dimensions of said bottom die, and which well forming elements further provide extendable/retractable fingers which can be caused to project from and retract into said well forming elements as desired by a user; which system is aligned for use by providing a bottom die to said system which bottom die comprises a bottom die central pivot means such that said bottom die central pivot means contacts an underlying surface of said system, which bottom die further comprises means for securing a position of said bottom die when it has been appropriately caused to pivot about said bottom die central pivot means, into an aligned position; causing said bottom die and well forming elements to be adjusted so that the well forming elements are separated by a distance which allows said bottom die to be lowered thereinto when said extendable/retractable fingers are retracted into said well forming elements but not when they are extended; causing said extendable/retractable fingers to be retracted into said well forming elements; causing said bottom die to be lowered into said well formed by said well forming elements to a point where an upper surface thereof is below the location at which said extendable/retractable fingers are located, and causing said extendable/retractable fingers to be extended above said upper surface of said bottom die; causing said bottom die to rise so that edges of an upper surface thereof makes contact with lower extents of said extended fingers, and so that said bottom die pivots about said bottom die central pivot means such that essentially uniform contact between edges of said upper surface of said bottom die and the lower extents of said extended fingers is achieved; and operating the means for securing a position of said bottom die when it has been appropriately caused to pivot about said bottom die central pivot, into an aligned position, to secure said bottom die in the position so achieved.

26. A system as in claim 25 in which the facing surfaces of said top and bottom dies make essentially uniform contact with one another when caused to make contact with one another by operation of said system, in which the top die is aligned by retracting said fingers into said well forming elements; providing a top die to said system, which top die comprises a top die central pivot element such that said top die central pivot means contacts an overlying surface of said system, which top die further comprises means for securing a position of said top die when it has been appropriately caused to pivot about said top die central pivot element, into an aligned position; causing said top die to lower such that a lower surface thereof which faces the upper surface of said bottom die is caused to essentially uniformly contact said upper surface of said bottom die, the edges of which upper surface of the bottom die were previously made to contact lower extents of said fingers when said fingers were extended from said well forming elements, so that said bottom die pivoted about its central pivot such that essentially uniform contact between edges of said upper surface of said bottom die and the lower extents of said extended fingers was achieved; and operating the means for securing a position of said top die when it has been appropriately caused to pivot about its central pivot, into an aligned position, to secure said top die in the position so achieved.

27. A system comprising top and bottom dies which system comprises means for connecting a top die and a bottom die therein such that in use facing surfaces of said top and bottom dies can be caused to come into essentially uniform contact with one another as in claim 25, in which the means for connecting a die therein comprises a quick release coupler.

28. A method for aligning top and bottom dies in a system so that facing surfaces of said top and bottom dies make essentially uniform contact with one another when caused to make contact with one another by operation of said system, comprising the steps of:

a. providing a system comprising means for connecting a top die and a bottom die therein such that in use facing surfaces of said top and bottom dies can be caused to come into essentially uniform contact with one another, said system comprising means for causing said top and bottom dies to reversibly approach and contact one another; which system further comprises well forming elements, which well forming elements can be adjusted so as to provide a well of overall dimensions just in excess of the overall outer dimensions of said bottom die, and which well forming elements further provide alignment marks;

b. providing a bottom die to said system which bottom die comprises a bottom die central pivot means such that said bottom die central pivot means contacts an underlying surface of said system, which bottom die further comprises means for securing a position of said bottom die when it has been appropriately caused to pivot about said bottom die central pivot means, into an aligned position;

c. causing said bottom die and well forming elements to be adjusted so that the well forming elements are separated by a distance which allows said bottom die to be lowered thereinto;

d. causing said bottom die to be lowered into said well formed by said well forming elements to a point where an upper surface thereof is below the location at which said alignment marks are located;

e. causing said bottom die to rise so that the upper surface thereof becomes aligned with respect to said alignment marks, and so that said bottom die pivots about said bottom die central pivot means such that essentially uniform alignment with said alignment marks is achieved;

f. operating the means for securing a position of said bottom die when it has been appropriately caused to pivot about said bottom die central pivot, into an aligned position, to secure said bottom die in the position achieved in step e.

29. A method for aligning top and bottom dies in a system so that facing surfaces of said top and bottom dies make essentially uniform contact with one another when caused to make contact with one another by operation of said system, as in claim 28, which method further comprises the step of:

a. providing a top die to said system, which top die comprises a top die central pivot means such that said top die central pivot means contacts an overlying surface of said system, which top die further comprises means for securing a position of said top die when it has been appropriately caused to pivot about said top die central pivot means, into an aligned position;

b. causing said top die to lower such that a lower surface thereof which faces the upper surface of said bottom die is caused to essentially uniformly contact said upper surface of said bottom die, the upper surface of which bottom die was previously made align with alignment marks;

c. operating the means for securing a position of said top die when it has been appropriately caused to pivot about its central pivot, into an aligned position, to secure said top die in the position achieved in step b.

* * * * *